350-336 SR
7/31/79 XR 4,163,230

United States Patent [19]

Konii

[11] 4,163,230

[45] Jul. 31, 1979

[54] DISPLAY DEVICE FOR ELECTRONIC TIMEPIECES

[75] Inventor: Tsuyoshi Konii, Kawagoe, Japan

[73] Assignee: Citizen Watch Co. Ltd., Tokyo, Japan

[21] Appl. No.: 810,074

[22] Filed: Jun. 27, 1977

Related U.S. Application Data

[63] Continuation-in-part of Ser. No. 705,258, Jul. 14, 1976.

[51] Int. Cl.[2] ..... G09F 9/32

[52] U.S. Cl. ..... 340/765; 58/50 R; 58/152 R; 340/784; 350/336

[58] Field of Search ..... 340/336; 58/50 R, 152 R; 313/510, 519; 350/336

[56] References Cited

U.S. PATENT DOCUMENTS

| | | | |
|---|---|---|---|
| 3,719,849 | 3/1973 | Steward | 340/336 X |
| 3,737,707 | 6/1973 | Yanagisawa | 313/519 |
| 3,831,166 | 8/1974 | Denardo | 340/336 |
| 3,925,777 | 12/1975 | Clark | 340/336 |
| 3,971,012 | 7/1976 | Morokawa et al. | 340/336 |

*Primary Examiner*—David L. Trafton
*Attorney, Agent, or Firm*—Sherman & Shalloway

[57] ABSTRACT

A display device for use in an electronic timepiece for effecting the display of many functions as well as time indication, so that a bearer may discern the display easily and precisely. The display device comprises compound-display elements with many functions, in addition to a numeral-display, and display elements associated with only numeric display, which are arranged on a display panel.

10 Claims, 14 Drawing Figures

DISPLAY DEVICE FOR ELECTRONIC TIMEPIECES

Related U.S. Application Data

This application is a continuation-in-part of application 705,258, filed July 14, 1976 and now abandoned.

BACKGROUND OF THE INVENTION

1. Field of the Invention

This invention relates to a display device for use in an electronic timepiece, particularly to an improved display means for displaying multiple functions in addition to time indication including the month, date and day of the week.

2. Description of the Prior Art

Heretofore, electronic digital timepieces have displayed the time, month, date and day of the week only. However, electronic timepieces have been continually developed and it has recently been possible to add many functions, i.e., blood pressure meter, clinical thermometer and the like, to the conventional time display and in combination with various kinds of sensors. However, display is a great problem in a timepiece with multiple functions.

In case of displaying time indication only, display "12:34" means 12 hours 34 minutes, customarily. In more complicated case, the display "$12{:}34_{26}$" implies 12 hours 34 minutes 26 seconds or 12 hours 24 minutes on the 26th day. A bearer easily may become familiar with such an abbreviated time display in a short time, since the unit or digit can be determined by use of a simple rule. However, a timepiece with multiple functions has to display, by the use of different units, temperature ° C., blood pressure value and the like, respectively. As a counter measure for this purpose, it is conceivable that a unit display element is arranged independently of the display of numerals. For example, in a digital chronometer, there is an available system in which the display "LAP" to display a lap time is positioned at a place where the numeral elements of the display are not located. However, this system is not convenient because of the timepiece being consequently complex in construction and large in size.

For example, when the display of a wrist watch with an electronic calculator is used as a calculator, time display numerals are utilized without the time display exclusive mark, i.e. a colon and the like, positioned between the numerals. In this sytem, the display used as a calculator is not uniform constant in the spaces between numerals, so that determination of unit is difficult and unnecessary space is required. In the case of its use for displaying time, even if there are six units of hours, minutes and seconds, most conventional devices have the display with eight digits, which is popular in the present table-type calculator. As a result, only six digits are displayed and its appearance is not good.

If the numeral segments are equally spaced and time marks such as colons, etc. are inserted into spaces between the numeral segments, the display is preferable in its appearance when used as a display for an electronic calculator, but the time display is not convenient since it is extremely narrowed. As functions other than the time display are not utilized simulatneously, a portion of the display surface is occupied by inactive display segments and an undesirable impression is effected by design.

SUMMARY OF THE INVENTION

An object of the invention is to provide a display device for a timepiece in which the above disadvantages are obviated.

Another object of this invention is to provide an improved display device, in which many different unit displays can be effected without spreading the area of the display, while the numeral elements are spaced evenly, not off-center or squeezed at the center of the display surface.

A further object is to provide a display device in which displays can be precisely read using the other data and which is simple in construction, low in cost and small in size.

These and other objects have been attained by the display device which comprises compound display elements including the other display functions with the display and the display elements for the numeral figures.

DETAILED DESCRIPTION OF PREFERRED EMBODIMENTS

Figure 1:
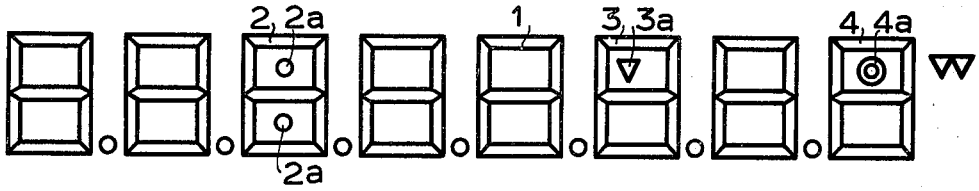
FIG. 1 is a plan view of an electrode pattern showing an embodiment of this invention.

FIG. 1 shows an electrode pattern diagram of a display device utilizing electro-optical effect such as liquid crystal, electro-chromic substance and the like. As shown, reference numeral 1 illustrates ordinary display elements for displaying numerals. Compound display elements 2, 3 and 4 in FIG. 1 include additional function symbols.

A symbol *2a* for indicating "hour" is incorporated in a compound display element 2; a symbol *3a* for indicating "minute" is incorporated in a compound display element 3; and a symbol *4a* to indicate "degree temperature" is patterned together with a compound display element 4. If the compound display elements including both the numeral pattern and the symbols to display time are combined with the ordinary numeric display elements 1, the time and units can be selectively displayed as shown in FIGS. 2A and 2B and as a result, may be easily discerned.

Figure 2A:
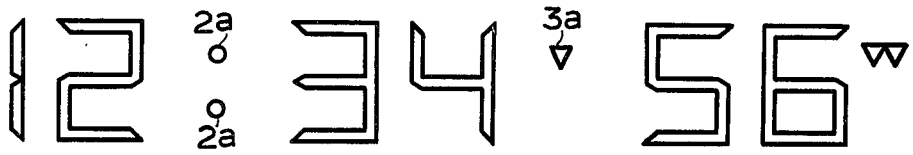
FIGS. 2A and 2B are plan views of an electrode pattern showing a detailed embodiment of this invenion.
Figure 2B:
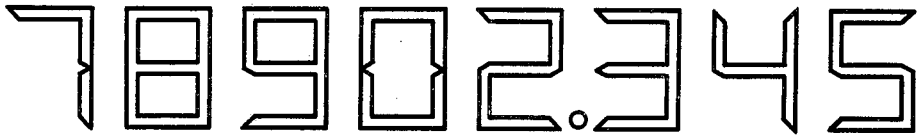

FIGS. 2A and 2B show detailed embodiments of this invention. FIG. 2A is an example of a time display wherein the symbol marks *2a*, *3a* are shown in the compound display elements 2, 3. This example illustrates "12 hours 34 minutes 56 seconds".

Figure 3A:
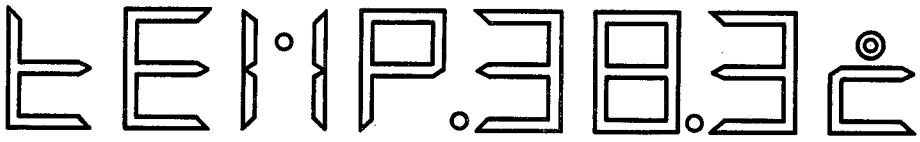
FIGS. 3A through 3D are plan views of an electrode pattern to display a temperature, blood pressure and golf count, respectively, according to this invention.
Figure 3B:
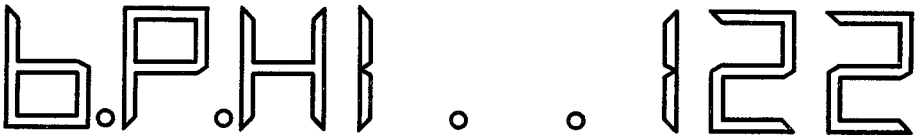
Figure 3C:
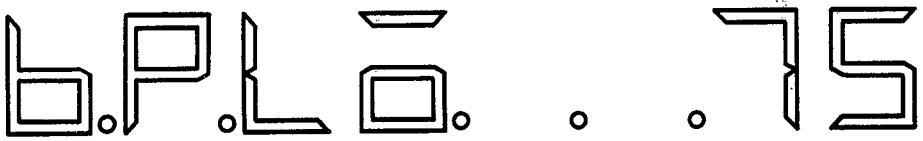

In FIG. 2B, there is shown a pattern for the display of an electronic calculator in which the solution "78902.345" is displayed. The compound display elements 2, 3, 4 are then extinguished. According to the above array of display elements, information other than the numerical information may be attained by using at least a part of the compound display elements. Other detailed embodiments are disclosed in FIGS. 3A and 3B. FIG. 3A shows an example wherein "TEP. 38.3° C." is represented to indicate atmospheric temperature or body temperature, etc. FIG. 3B shows "b.P.HI..122" indicating that the maximum blood pressure is 122 mmHg. FIG. 3C shows "b.P.Lo..75" indicating that the minimum blood pressure is 75 mmHg.

Figure 3D:
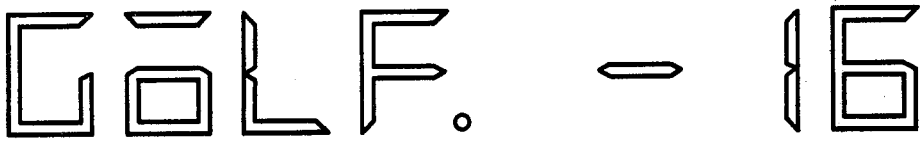
Figure 4A:
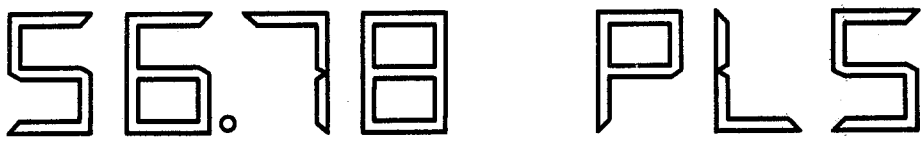
FIGS. 4A through 4D are plan views of a modified electrode pattern according to this invention.

FIG. 3D shows "GOLF - 16" displaying a golf count. FIG. 4A shows "56.78 PLS" displaying that a pulse count is 56.78. "PLS" means a pulse unit and is an abbreviated term of German "PULS" or English "PULSE".

Figure 4B:
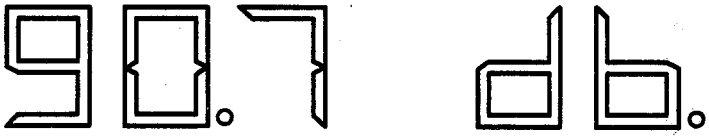
Figure 4C:
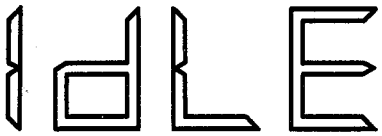
Figure 4D:
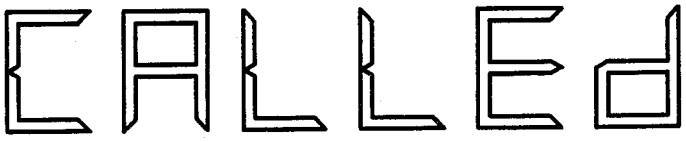

FIG. 4B shows an example wherein decibel "90.7db" is displayed and FIG. 4C shows "idle" indicating that the time-piece function is not normal. FIG. 4D shows "CALLED", indicating that the bearer is being called in a page watch, etc.

Figure 5:
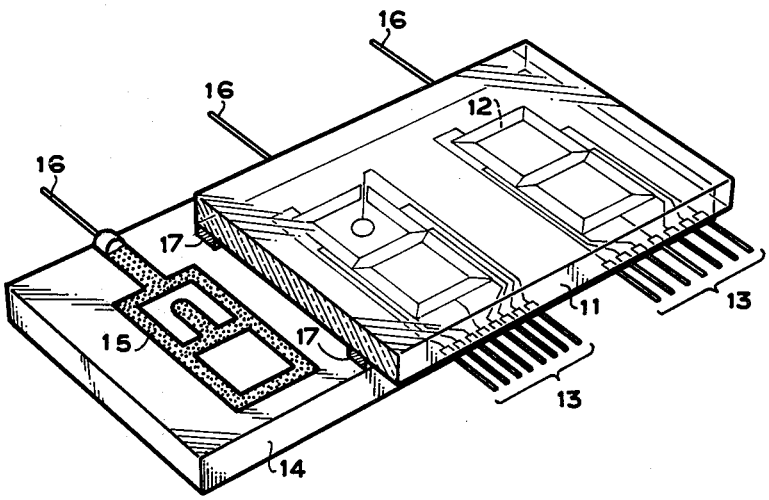
FIG. 5 is a perspective view, partly in section, of a preferred form of display elements.
Figure 7:
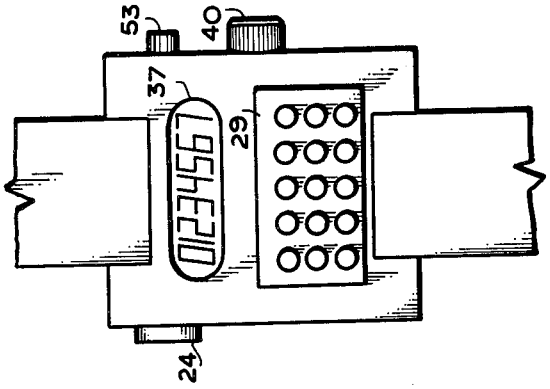
FIG. 7 is a plan view of a multi-function timepiece.

FIG. 5 shows a liquid crystal display in which reference numeral 11 depicts an upper glass plate to which there are attached segment-shaped, transparent electrode 12 to apply voltage to a liquid crystal on the rear side. Lead wires 13 are electrically coupled to the electrodes and the other ends of the lead wires are connected with an external control circuit. A supplemental lead wire is connected to a compound element 3*a*. Reference numeral 14 denotes a lower plate having a common electrode 15 attached on the front side. The common electrode 15 underlies the transparent electrodes 12 and serves as one terminal to apply the voltage to the liquid crystal. Lead wires 16 are electrically connected to the common electrode 15 and are coupled with an external circuit (not shown). The upper glass plate 11 and the lower plate 14 are spaced at their periphery by means of a seal member 17 such that the transparent electrode 12 and common electrode 15 are aligned with each other and the whole structure is a sealed container. Liquid crystals (not shown) are enclosed in a space surrounded by the upper glass plate 11, the lower plate 11 and the sealing member 17, and preferably are divided into seven segments, as is conventional. A triangular crystal is positioned in the zone 3*a* within the numeral element 3 while dot-shaped crystals are positioned within the open spaces of the numeral element 2.

Figure 6:
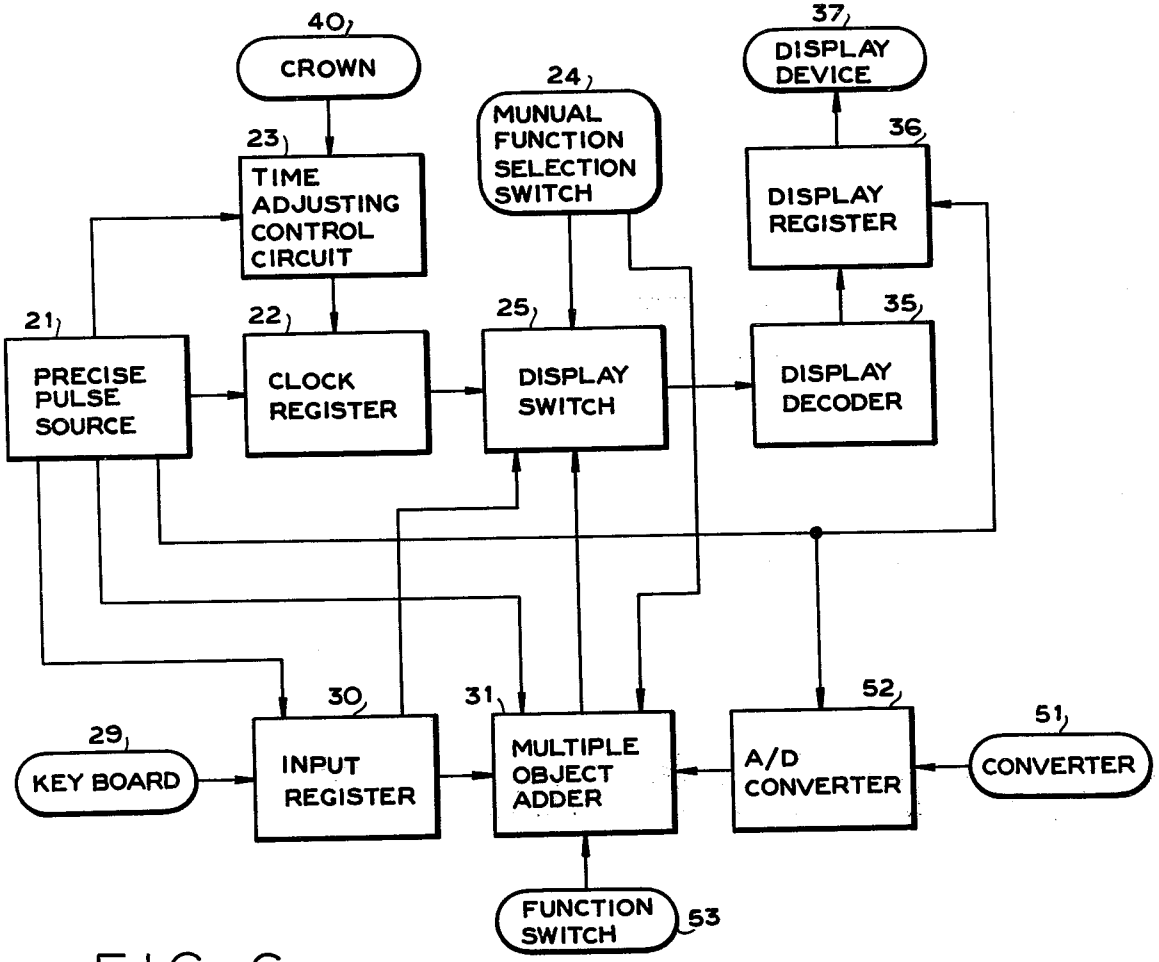
FIG. 6 is a block diagram showing a multi-function electronic timepiece.

Manual switching may change time display to other displays as desired. It is possible to incorporate into an integrated circuit a circuit which detects, counts and memorizes the unit information in the interior of a timepiece. In FIG. 6, 21 depicts a precise pulse source including an oscillator with a suitable frequency, e.g. a crystal oscillator which transmits various outputs to control the transmission of data in the device according to this invention and is provided with a frequency divider with 1 HZ output to advance a clock register 22. The clock register 22 adds and transacts the 1 HZ signal from the frequency divider to synthesize the time signal.

When a crown 40 is actuated by a wearer, a time adjusting control circuit 23 receives a suitable timing pulse train from the precise pulse source 21 so as to reset the parts corresponding to hour, minute and second in the clock registrater 22. Then the output from the clock register 22 is delivered to a display switch 25.

In the calculating mode, the numeral entered manually by the key boad 29 is converted into a code so as to be transmitted to an input register 30 and is memorized as the occasion demands. From the input register 30, instantly-displayed information is delivered to a display switch 25 while accumulated data are added in a multiple object adder 31. The temperature or pressure is converted into analogous signals by means of a converter 51 and signals are converted to digital signals by an A/D converter and these signals being transmitted to the multiple object adder 31. The signals from a switch 53 which is manually actuated are used in the counter or chronograph mode.

The actuation of the manual function selection switch 24 selects the output from the display switch 25 between the time signal and the multiple object adder 31 and simultaneously determines which of the data is added to the multiple object adder 31. The output signal of the display switch is transmitted to the display decoder 35 to be converted into a basic seven-segment code and to be stored temporality in the display register 36 and thereby being displayed on the display device 37. The leads 13*a* of the compound display elements are also served by the decoder 35.

The display of the present invention is not unbalanced in either the time display or the other displays of informations. The numerals are spaced evenly, the group of displayed figures is not offcenter and is not squeezed at the center of the display.

In FIG. 1, the colon ":" may be replaced by "hr" and "▽▽" and "min" respectively. These marks may also serve as overflow display, zero division display and memory address display, etc. This invention thus provides a display in which marks other than decimal marks are not inserted between ordinary numeral figures. Many and various units can be displayed without enlarging the display surface. Therefore, multi-function data is not read erroneously and an electronic timepiece simple in structure, comparatively cheap in cost and small in size can be provided. In addition, this device may be used as a memory in addition to the display of variable amounts.

What is claimed is:

1. An electro-optical display for use in an electronic timepiece displaying at least a first function and a second function, said display comprising a plurality of segmented numeric-display elements arranged in a course to display numbers representing information of the first and second functions of the timepiece, at least one compound display element in said course of numeric-display, elements, said compound display element including seven electro-optical display segments having rectangular shapes and positioned in a figure-eight pattern forming two free areas between the segments, said display segments being positioned to display a range of numerals representing information of the first function only of the timepiece upon selective actuation thereof, and an electro-optical signal member having a non-rectangular shape and positioned within one of the two free areas between said electro-optical segments, said member indicating the second function only of the timepiece.

2. The electro-optical display of claim 1 in which a plurality of compound display elements are included in the course of numeric display elements with two numeric display elements between adjacent compound display elements.

3. The electro-optical display of claim 1 in which said electro-optical signal member includes two components, each in a separate one of the two free areas of the figure-eight pattern.

4. The electro-optical display of claim 1 in which said electro-optical member is a small circle indicating degrees.

5. The electro-optical display of claim 1 in which said electro-optical member is an apostrophe indicating minutes.

6. The electro-optical display of claim 4 in which each component is a dot resulting in said electro-optical signal member being a colon indicating hours.

7. The electro-optical display of claim 2 in which said electro-optical signal member includes two components, each in a separate one of the two free areas of the figure-eight pattern.

8. The electro-optical display of claim 2 in which said electro-optical signal member is a small circle indicating degrees.

9. The electro-optical display of claim 2 in which said electro-optical signal member is an apostrophe indicating minutes.

10. The electro-optical display of claim 7 in which each component is a dot resulting in said electro-optical signal member being a colon indicating hours.

* * * * *